United States Patent [19]

Thomas

[11] 4,388,183

[45] Jun. 14, 1983

[54] SWIRLING AIR CENTRIFUGAL SCATTER CLASSIFIER

[75] Inventor: Franz Thomas, Beckum, Fed. Rep. of Germany

[73] Assignee: Christian Pfeiffer, Beckum, Fed. Rep. of Germany

[21] Appl. No.: 304,334

[22] Filed: Sep. 21, 1981

[30] Foreign Application Priority Data

Oct. 13, 1980 [DE] Fed. Rep. of Germany ..... 3038625

[51] Int. Cl.[3] ..... B07B 7/083

[52] U.S. Cl. ..... 209/139 A; 209/148

[58] Field of Search ..... 209/139 A, 148, 139 R

[56] References Cited

U.S. PATENT DOCUMENTS

| | | | |
|---|---|---|---|
| 667,573 | 2/1901 | Pfeiffer | 209/139 A |
| 1,165,866 | 12/1915 | Fraser | 209/148 |
| 1,346,015 | 7/1920 | Gibson et al. | 209/148 |
| 3,308,949 | 3/1967 | Schauer | 209/139 R X |

FOREIGN PATENT DOCUMENTS

| | | | |
|---|---|---|---|
| 431147 | 7/1935 | United Kingdom | 209/139 A |

*Primary Examiner*—Ralph J. Hill

*Attorney, Agent, or Firm*—Holman & Stern

[57] ABSTRACT

A classifier using a swirling air current has two or more scatter plates turning about a common axis at different speeds and designed for causing outward motion of feed towards baffle rings placed round and turning with the scatter plates.

14 Claims, 1 Drawing Figure

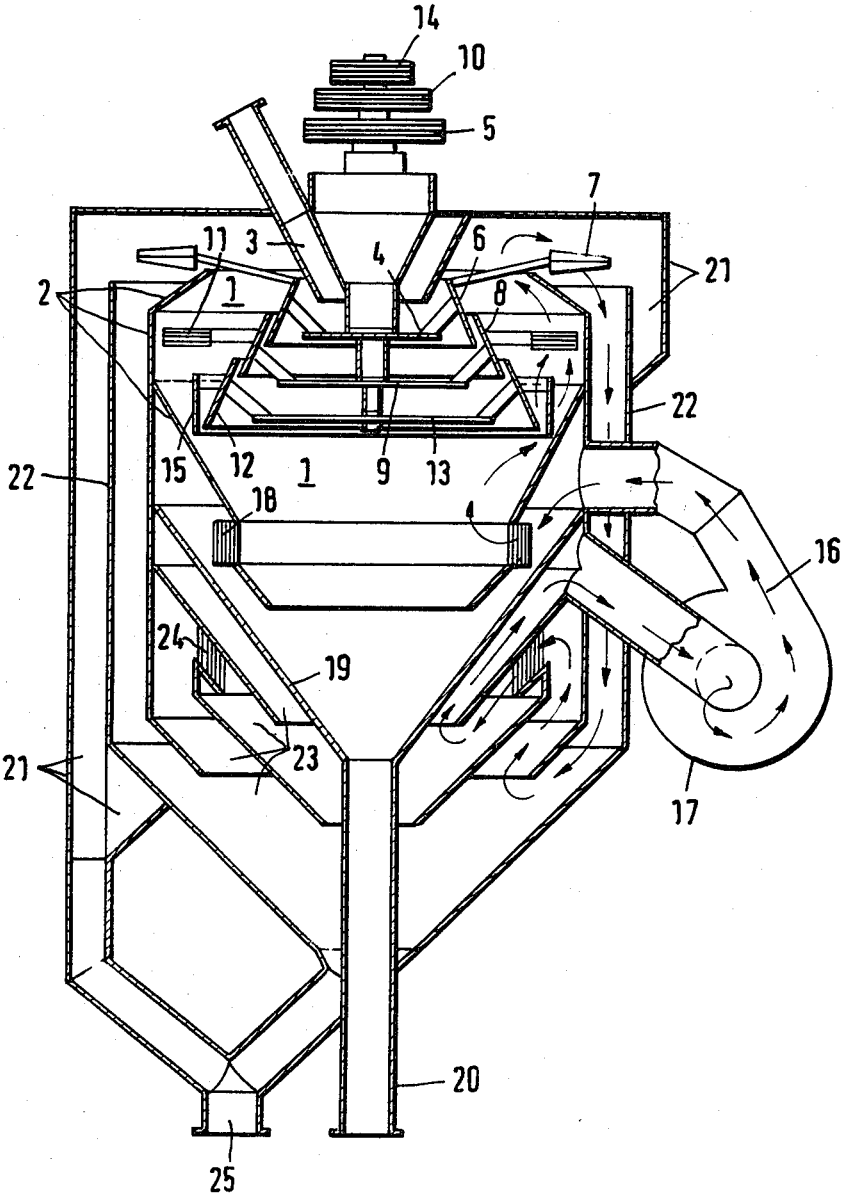
14
10
5
7
11
3
4
6
21
2
1
8
22
15
12
1
9
13
22
18
16
24
19
23
21
17
20
25

SWIRLING AIR CENTRIFUGAL SCATTER CLASSIFIER

BACKGROUND OF THE INVENTION

The present invention is with respect to a swirling air centrifugal scatter classifier having at least two scatter plates with separate driving systems for turning them at different speeds about a common upright axis, the upper scatter plate, which is smaller in diameter than the lower scatter plate, having a baffle ring on it for turning with it, the classifier having a feed inlet funnel over the top plate, and a system for producing classifying air current.

In the prior art swirling air apparatus has been produced for classifying materials by using an air current and having an inner fan turning concentrically about the feed inlet funnel and in the case of which a screen concentrically spaced round a scatter plate is open at its lower end and is designed for turning with the scatter plate, the screen becoming wider in a downward direction. In the case of such a swirling air apparatus using an air current for classifying suggestions had been made for placing parts such as blades, grids or other structures between the scatter plate and the fan, such parts being turned with the plate and causing the grains of material to be moved in an outward direction.

SHORT OUTLINE OF THE INVENTION

The present invention is based on discovery and knowledge that the degree of resolution of the separating effect of a classifier with a middle feed inlet funnel is dependent on the degree to which the small-size solid grains of the feed are cleared from the swirling air so that there is no chance of such small-size grains being mixed up with the large-size grains. For this reason one purpose of the present invention is that of clearing, to the highest degree possible, the small-size grains of solid from swirling air which is being moved concentrically and evenly along short paths without making any great change in the known design of swirling air classifying apparatus and, however, without any cyclone separating system with its own shortcomings.

For effecting these and other purposes at least the lower second scatter plate has its own baffle ring designed to be turned therewith. As part of a further development of the invention there is a third scatter plate which as well has its own baffle ring designed to be turned therewith.

As part of a still further outgrowth of the general teaching of the invention, a special system is fixed to each baffle ring for speeding up the clearing of the smallest-size solid grains mechanically, and the system, turning with the lowest scatter plate, is responsible for the first stage of separating or cleaning and the system designed for turning with the topmost scatter plate is responsible for the main clearing of the smallest-size solid grains from the swirling air; for producing a high-level effect on separating the solids from the air (or gas phase) each part of the apparatus made up of a scatter plate, a baffle ring and a system is turned at a different speed to be in line with the desired function.

One useful effect produced by the invention is to be seen in the fact that the solids are cleared from the swirling air mostly by a mechanical effect and not, as in the prior art, by changing the direction of motion of high speed or large air currents with the use of a great amount of power.

For the last stage of clearing the rest of the grains from the swirling air a generally small amount of swirling air only is needed if it is guided by a number of concentric guiding parts.

As a further part of the invention a ring-like take-up pocket is present, free of swirling air, to take up the small-size grains which, because of the parts fixed inside the topmost baffle ring, are moved round outside the top edge of the classifying space.

Because of the structure of the invention the overall size of the classifier is smaller and the separating resolution is better. Furthermore the housing of the classifier does not have to be designed with high-price wear-proofing parts and no high-price upkeep work is necessary: Because in the invention the walls of the housing are not acted upon by powerful air currents there is little wear of such inner faces, the only wearing parts being the acting faces of the mechanical systems.

DETAILED ACCOUNT OF WORKING EXAMPLE OF THE INVENTION

Further details of the invention will be seen from the single FIGURE which is a diagrammatic upright section of one working example of the invention.

The classifying space 1 to be seen in the FIGURE is walled in by the inner housing 2, the middle, upper feed inlet funnel 3 running into the classifying space 1 for inlet of the feed to be classified onto a first scatter plate 4. Scatter plate 4 is turned by a first driving system 5 and has fixed on it a first coned baffle ring 6 so that the ring 6 is turned with the plate 4. Further inner structures are fixed to baffle ring 6 and in the present working example such inner structures take the form of a "stirrer" 7 having the function of speeding up the grains of the feed, and which is turned together with the scatter plate 4 and the baffle ring 6. Material to be classified makes its way outwards, impacting against the baffle ring 6, it then being moved towards the lower second baffle ring 8, which is turned, together with the second scatter plate 9, by a separate second driving system 10. Further inner structures are present for turning with the second baffle ring 8, and in the present working example such inner structures may be blades 11, such blades being responsible for fixing the limit of separating, with respect to size, of the small-size grains of feed. From the second baffle ring 8 the feed to be classified makes its way through the still lower third baffle ring 12 which is joined up with the third scatter plate 13 and is turned therewith by a third driving system 14. A further system or group of inner structures 15 is fixed to the third baffle ring 12, such structures in the present working example taking the form of a round sheet metal skirt 15 which may be moved axially for adjustment. Sheet metal skirt 15 is used for positively changing the direction of and guiding the swirling air 16, whose direction of motion is marked by arrows. In addition to the at least one stirrer 7 on the first baffle ring 6, the at least one blade 11 on the second baffle ring 8, and the round skirt 15 on the third baffle ring 12, the inner structures attached to the various baffle rings may have forms selected from among at least one rod, at least one grid, and at least one round plate.

At the same time this sheet metal skirt 15 is used as a guiding or deflecting edge for the moving sheet or veil of the material to be classified as moved outwards from the outer edge of the third baffle ring 12 into the classifying space 1, in which the air is kept on the move, that is to say swirled or circulated, by way of a fan 17 placed without the classifier. The upwardly moving current of classifying air 16 produced by outer fan 17 and making its way through the ring 18 of guide blades into the classifying space 1 firstly has the large-size grains of feed separated from it, such large-size grains falling into funnel 19 and making their way out of the apparatus by way of a pipe 20 for such material. The small-size grains of feed, making their way out of the system of blades 11 together with the swirling air, make their way current-wise concentrically round the top edge of the inner housing 2, at which position the swirling air is changed in direction and is acted upon by the "stirrer" 7 so that the current is speeded up and a large part of the solid grains is mechanically separated from the swirling air and makes its way into the ring-like take-up pocket 21 which is free of swirling air. The small amount of grains of feed still in the swirling air makes its way with the same into a ring-like space and is partly separated from the air at the round skirt-like part 22 of the apparatus. Placed concentrically under the funnel 19 for large-size grains there is a multi-stage mechanical separating unit 23 which at a number of points is designed for changing the direction of motion of the material. Such unit furthermore has a ring 24 of guide blades for supporting the sheet metal guides. In the multi-stage separating unit 23 dust is generally speaking completely cleared from the swirling or circulating air, the take-up pocket 21 and the outlet from the unit 23 opening into a second pipe 25 for small-grain material.

I claim:

1. In a scatter classifier having a housing, a system for producing a swirling gas current in said housing, an upper first scatter plate, a lower second scatter plate under said upper plate, a system for turning said plates about a common upright axis at different speeds, said lower second plate having a greater diameter than said upper first plate, a middle feed inlet duct over said upper first plate, a system without said housing for producing a classifying gas current within said housing, said upper first plate having a first baffle ring thereon and designed to be turned therewith for guiding said feed, as moved by said plate, with a baffle function, the improvement residing in that said lower second plate has a second baffle ring thereon designed to be turned therewith.

2. The classifier as claimed in claim 1, having a third, still lower, scatter plate and a third baffle ring fixed to said third scatter plate for turning therewith.

3. The classifier as claimed in claim 2 wherein the first baffle ring has an inner structure fixed thereto in the form of at least one stirrer; the second baffle ring has an inner structure fixed thereto in the form of at least one blade; and the third baffle ring has an inner structure fixed thereto in the form of a round skirt capable of adjustment by axial movement.

4. The classifier as claimed in claim 1 having a structure fixed to the first and uppermost baffle ring and designed for speeding up solid feed to be classified, said structure being designed to be turned with said first baffle ring.

5. The classifier as claimed in any one of claims 1 or 2, having a ring-like take-up pocket for small-size grains of feed from the swirling air, such grains being put in motion by parts on said topmost baffle ring at a position past and outside a top limit of the classifying space.

6. The classifier as claimed in claim 1 wherein at least one baffle ring has an inner structure fixed thereto in the form of at least one stirrer.

7. The classifier as claimed in claim 1 wherein at least one baffle ring has an inner structure fixed thereto in the form of at least one blade.

8. The classifier as claimed in claim 7 wherein the at least one blade is fixed to the lower second baffle ring.

9. The classifier as claimed in claim 1 or 2 wherein at least one baffle ring has an inner structure fixed thereto in the form of at least one rod.

10. The classifier as claimed in claim 1 or 2 wherein at least one baffle ring has an inner structure fixed thereto in the form of at least one grid.

11. The classifier as claimed in claim 1 or 2 wherein at least one baffle ring has an inner structure fixed thereto in the form of at least one round plate.

12. The classifier as claimed in claim 6 wherein the at least one stirrer is fixed to the upper first baffle ring.

13. The classifier as claimed in claim 2 wherein at least one baffle ring has an inner structure fixed thereto in the form of a round skirt.

14. The classifier as claimed in claim 2 wherein the third still lower baffle ring has an inner structure fixed thereto in the form of a round skirt capable of adjustment by axial movement.

* * * * *